US005839292A

United States Patent [19]

Hwang

[11] Patent Number: 5,839,292

[45] Date of Patent: Nov. 24, 1998

[54] DEFROSTER FOR HEAT PUMP

[75] Inventor: Yun Je Hwang, Seoul, Rep. of Korea

[73] Assignee: LG Electronics, Inc., Rep. of Korea

[21] Appl. No.: 783,455

[22] Filed: Jan. 16, 1997

[30] Foreign Application Priority Data

Aug. 31, 1996 [KR] Rep. of Korea ..... 37511/1996

[51] Int. Cl.[6] ..... F25B 41/00

[52] U.S. Cl. ..... 62/152; 62/278; 62/324.5

[58] Field of Search ..... 62/151, 152, 196.4, 62/277, 278, 81, 160, 324.5, 324.1, 324.6, 324.3

[56] References Cited

U.S. PATENT DOCUMENTS

| | | | |
|---|---|---|---|
| 3,572,052 | 3/1971 | Toth | 62/278 |
| 3,732,703 | 5/1973 | Nordstrom et al. | 62/324.3 |
| 4,774,813 | 10/1988 | Yokoyama | 62/81 |

FOREIGN PATENT DOCUMENTS

| | | | |
|---|---|---|---|
| 5-113276 | 5/1993 | Japan | 62/152 |
| WO 84/03138 | 8/1984 | WIPO | 62/152 |

*Primary Examiner*—Harry B. Tanner
*Attorney, Agent, or Firm*—Fish & Richardson PC

[57] ABSTRACT

A defroster for a heat pump to remove frost which falls on an evaporator during a heating operation of the heat pump. The defroster includes a condenser, compressor, and a cylindrical converting valve. A by-pass tube branches off at an outlet of the compressor to induce refrigerant and an on-off valve selectively induces the refrigerant into the bypass tube. A first inlet tube is formed at an upper portion of the cylindrical converting valve for receiving refrigerant drawn by the bypass tube and a first outlet tube emits the refrigerant into an upper portion of the evaporator. A second inlet tube is formed at a lower portion of cylindrical converting valve for receiving refrigerant coming from the condenser and a second outlet tube emits the refrigerant into a lower portion of the evaporator. A converting plate, rotating in the cylindrical converting valve, connects the first inlet tube with the first outlet tube, while connecting the second inlet tube with a second outlet tube.

3 Claims, 7 Drawing Sheets

------- General heating cycle

——— Heating cycle of the present invention

——— Cycle of the bypassed refrigerant

DEFROSTER FOR HEAT PUMP

BACKGROUND OF THE INVENTION

1. Field of the Invention

The present invention relates to a defroster for a heat pump and, more particularly, to a defroster for heat pump for removing frost which falls on an evaporator during heating of the heat pump.

2. Discussion of the Related Art

Generally, a heat pump is capable of both heating and air conditioning operations. If the surface temperature of a heat exchanger(e.g. an evaporator) is lower than a dew-point of the outside air and is below zero, frost is formed on the heat exchanger of the heat pump. The possibility of frost formation is substantially increased when the temperature of the outside air is below 5° C. and the humidity of the outside air is above 65%.

FIG. 1 illustrates a heating operation cycle of a conventional heat pump. A high-temperature and high-pressure refrigerant is discharged from a compressor 9 and sent to a condenser by way of a four direction valve 14. The heat of the refrigerant is emitted at the condenser of an inside unit 15 into outside air supplied by a blowing fan 17. The condensed refrigerant is evaporated at an evaporator 1 of an outside unit after the pressure of the refrigerant is reduced by passing the refrigerant through a capillary tube 8. At the evaporator 1, the refrigerant absorbs heat from the outside air supplied by the blowing fan 17. The interior of a room is warmed up as the refrigerant circulates between the compressor 9 and the evaporator 1 repeatedly.

However, this conventional heat pump is disadvantageous in that frost falls on the evaporator 1 of the heat pump if a dew-point temperature of the supplied outside air is higher than a temperature of the refrigerant and the temperature of the outside air is below zero. The frost on the evaporator turns to ice within a few minutes and obstructs the supply of outside air generated by the blowing fan 17. The evaporator 1 stops functioning as the supply of the outside air is stopped. When evaporation is stopped the refrigerant flow is reduced and the pressure of the condenser 15 (the high-pressure portion) is also reduced. The reduction of the pressure leads to a drop in the condensing temperature, so that the heat pump cannot supply a sufficient amount of heat for heating a room. To defrost the evaporator, a user must change from the heating operation to the air-conditioning operation. The evaporator of the heating operation is used as a condenser during the air-conditioning operation, so that heat emitted from the condenser of the air-conditioning operation removes the frost. This results in cool air entering the interior of the room.

SUMMARY OF THE INVENTION

The invention is directed to a defroster for a heat pump.

It is an object of the present invention to provide a defroster for a heat pump which removes frost formed on an evaporator without interrupting a heating operation of the heat pump.

To accomplish the object of the present invention, there is provided a defroster for a heat pump. The defroster includes refrigerant drawing means for drawing out a high-temperature refrigerant from an outlet of a compressor, the refrigerant circulating in the heat pump, and refrigerant distributing means installed at an inlet of an evaporator for supplying both a refrigerant coming from a condenser and the high-temperature refrigerant into the evaporator in separated states.

The refrigerant drawing means includes a bypass tube branching off at the outlet of the compressor for inducing the refrigerant, and an on-off valve for selectively inducing the refrigerant into the bypass tube.

The refrigerant distributing means alternately sends the two kinds of refrigerant into an upper portion and a lower portion of the evaporator.

The refrigerant distributing means includes a cylindrical converting valve, a first inlet tube formed at an upper portion of the a cylindrical converting valve for receiving refrigerant drawn by the refrigerant drawing means, a first outlet tube level with the first inlet tube for emitting refrigerant into the upper portion of evaporator, a second inlet tube formed at an lower portion of the a cylindrical converting valve for receiving refrigerant coming from a condenser, a second outlet tube level with the second inlet tube for emitting refrigerant into the lower portion of the evaporator; and a converting plate rotating in the cylindrical converting valve for connecting the first inlet tube with the first outlet tube while connecting the second inlet tube with the second outlet tube, or for connecting the first inlet tube with the second outlet tube while connecting the second inlet tube with the first outlet tube.

The refrigerant distributing means alternately may send the two kinds of refrigerant into an upper portion, a middle portion, and a lower portion of the evaporator.

The defroster for a heat pump also can include a check valve installed at an outlet of the evaporator for preventing refrigerant from flowing backward.

It is to be understood that both the foregoing general description and the following detailed description are exemplary and explanatory and are intended to provide further explanation of the invention as claimed.

BRIEF DESCRIPTION OF THE DRAWINGS

The above and/or other objects, features and advantages of the present invention will be more clearly understood from the following detailed description taken in conjunction with the accompanying drawing, in which.

DETAILED DESCRIPTION OF THE PREFERRED EMBODIMENT

Figure 1:
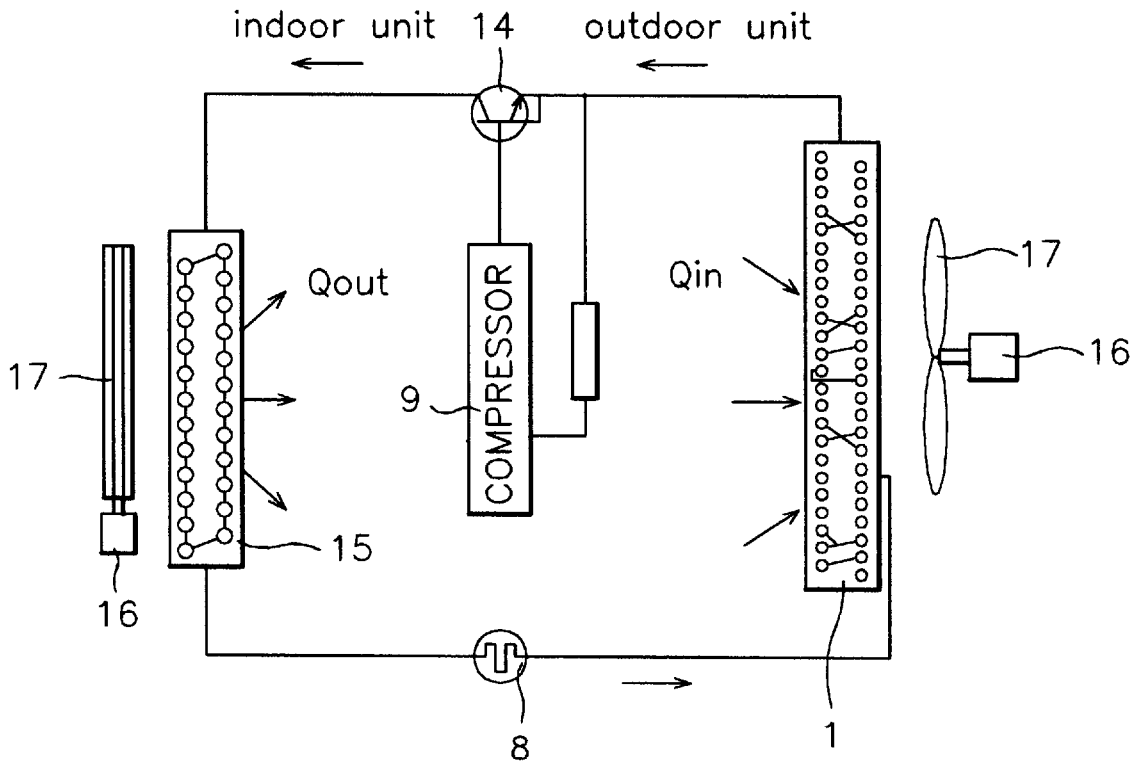
FIG. 1 PRIOR ART
FIG. 1 is a configuration view illustrating a heating operation cycle of a conventional heat pump.

A first embodiment of the invention will be described in detail with reference to FIGS. 2 to 5.

FIGS. 4 and 5 show a cylindrical converting valve 3 installed on a side of an evaporator 1. The converting valve 3 has a converting plate 2 that rotates at a right angle. When defrosting an upper portion or a lower portion of the evaporator 1, the converting plate 2 rotates at a right angle. The converting valve 3 also has a first inlet tube 4, a second inlet tube 5, a first outlet tube 6, and a second outlet tube 7 located on its sides. The first inlet tube 4 is coupled to a supplementary capillary tube 12, and the second inlet tube 5 is coupled to a capillary tube 8. The first outlet tube 6 is coupled to the upper portion of the evaporator 1, and the second outlet tube 7 is coupled to the lower portion of the evaporator 1.

A bypass tube 10 is located between the first inlet tube 4 and an outlet of a compressor 9. The bypass induces a high-temperature and high-pressure refrigerant into the evaporator 1. The refrigerant is circulated along a passage formed in a heat pump while converting its states into liquid or gas. The bypass tube 10 has an on-off valve 11 that selectively induces the high-temperature and high-pressure refrigerant into the bypass tube 10. The bypass tube 10 is coupled to the supplementary capillary tube 12 which turns the high-temperature and high-pressure refrigerant into a refrigerant having a suitable temperature and pressure.

A check valve 13 is located at an outlet of the evaporator 1 for preventing refrigerant from flowing backward.

Figure 2:
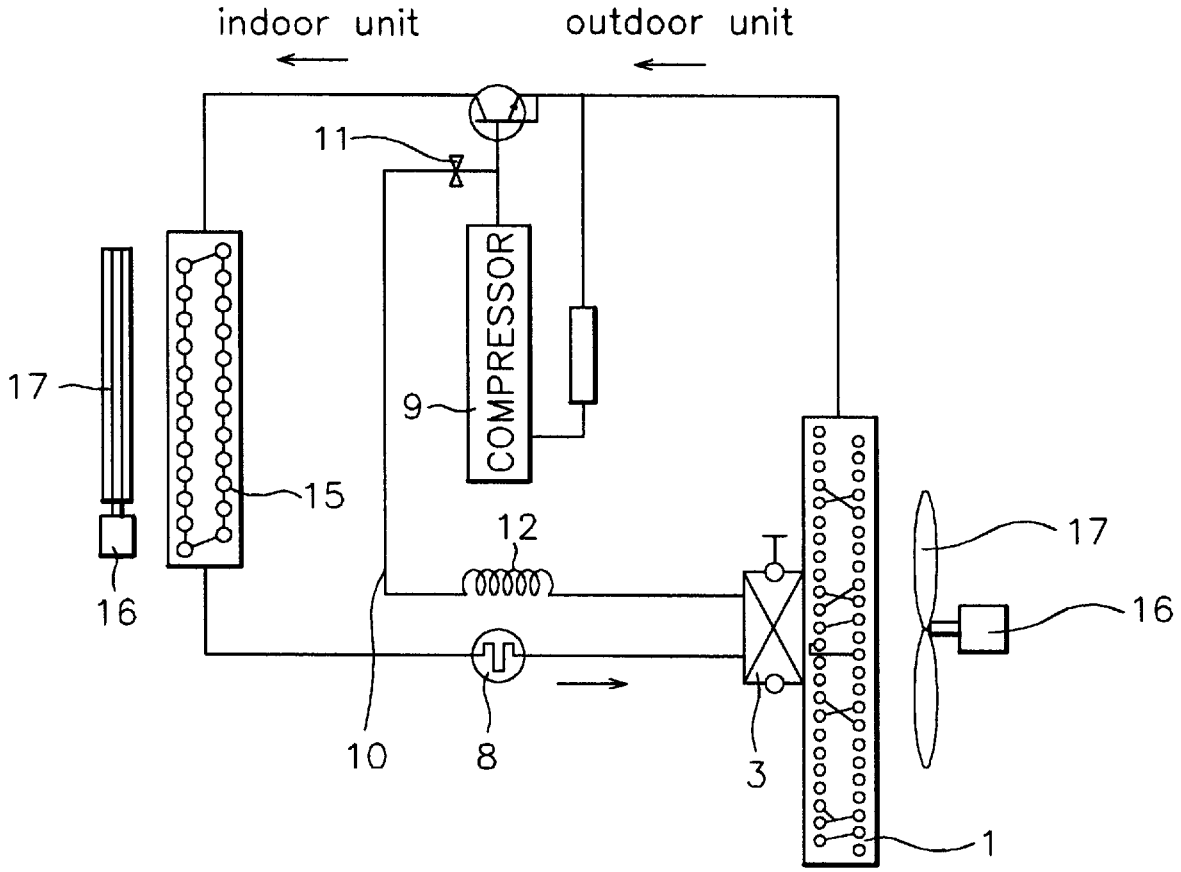
FIG. 2 is a configuration view illustrating a heating operation cycle of a heat pump in accordance with an embodiment of the present invention.

FIGS. 2 and 5 illustrate the operation of the first embodiment. If the on-off valve 11 is turned on, a portion of the refrigerant goes into the first inlet 4 of the converting valve 3 through the supplementary capillary tube 12 in which a gas refrigerant having a high-temperature and high-pressure is turned into a refrigerant having a temperature and proper pressure. In the meantime, a majority of the refrigerant goes into the second inlet 5 of the converting valve 3 through the compressor 9, the condenser 15, and the capillary tube 8. The function of the capillary tube 8 is to expand the refrigerant that goes through the capillary.

Figure 5A:
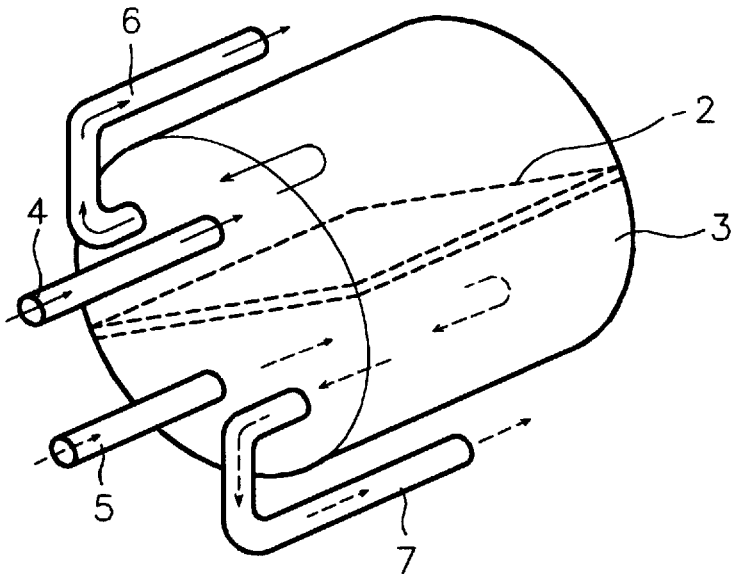
FIG. 5*a* is a view illustrating operation of a converting valve of the embodiment of FIG. 2 when defrosting frost on the upper portion of the evaporator.
Figure 5B:
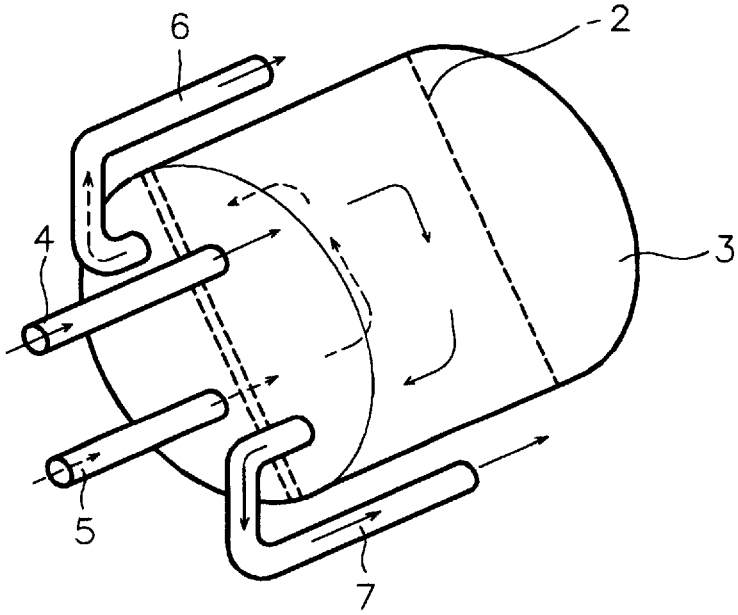
FIG. 5*b* is a view illustrating operation of a converting valve of the embodiment of FIG. 2 when defrosting frost on the lower portion of the evaporator.

The refrigerant entering a first inlet 4 is in the state of a high-temperature gas and the refrigerant entering the second inlet 5 is in the state of a two phase mixture, that is, a saturated refrigerant. As shown in FIG. 5, the two kinds of refrigerant go into the interior of the converting valve 3 without mixing, for defrosting the upper portion or the lower portion of the evaporator 1. During defrosting of the upper portion as shown FIG. 5*a*, the high-temperature refrigerant goes into the first outlet tube 6 while the saturated refrigerant goes into the second outlet tube 7. During defrosting of the lower portion as shown FIG. 5*b*, the high-temperature refrigerant goes into the second outlet tube 7 while the saturated refrigerant goes into the first outlet tube 6. As the converting plate 2 in the converting valve 3 rotates at a right angle, the upper portion and the lower portion of the evaporator 1 are defrosted periodically.

Figure 4A:
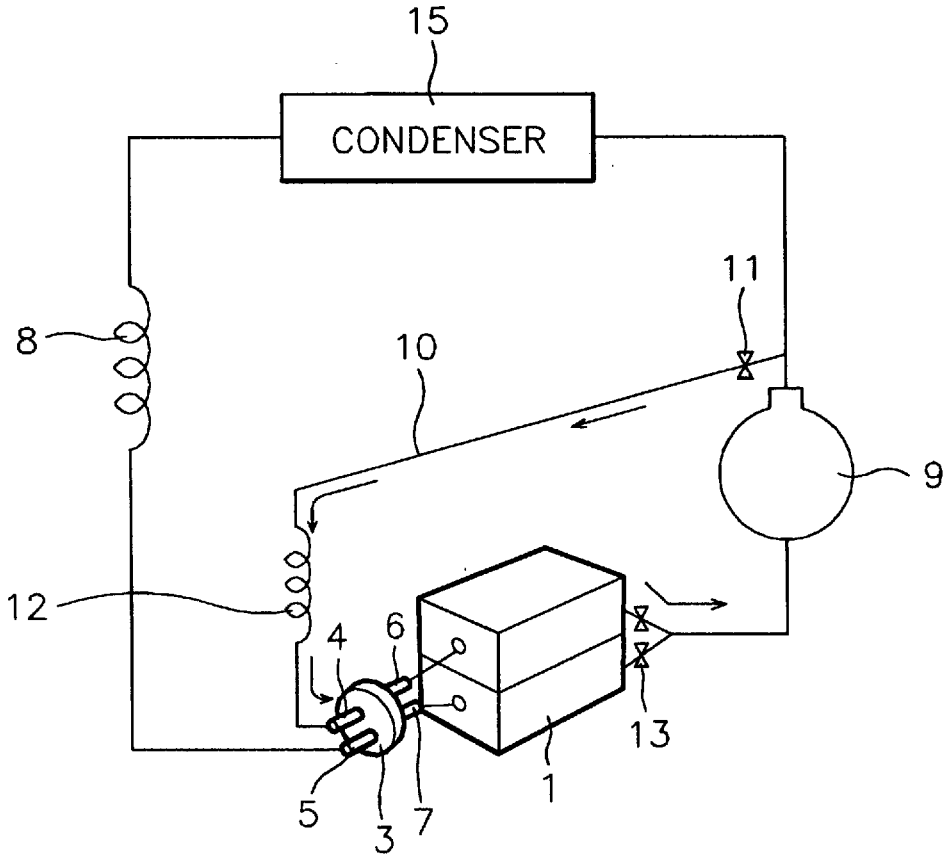
FIG. 4*a* is a view illustrating a main operation of the embodiment of FIG. 2 when defrosting frost on an upper portion of the evaporator.
Figure 4B:
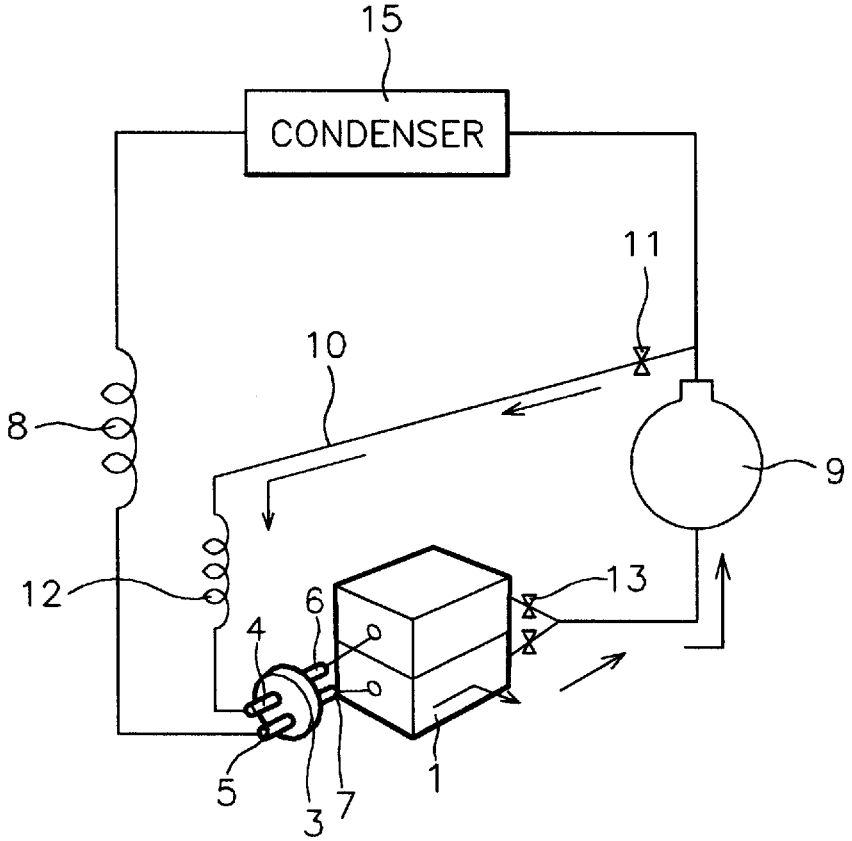
FIG. 4*b* is a view illustrating a main operation of the embodiment of FIG. 2 when defrosting frost on a lower portion of the evaporator.

FIGS. 4*a* and 4*b* shows that the direction of the refrigerant flow is changed periodically according to the portion that is defrosted. Because frost is uniformly distributed on the surface of the evaporator 1, the upper or the lower portion of the evaporator 1 is selected randomly. The selected portion is first defrosted, and then the other portion is defrosted, alternating continuously. Defrosting periodically not only prevents frost from growing, but also removes frost.

When the heat pump is operated in a normal mode, the on-off valve 11 of the bypass tube 10 is turned off.

The function of the capillary tube 8 is to keep pressure on the inlet tube 4. The inlet tube 4 must have a saturated pressure in which a temperature of the refrigerant is 0° C. to 5° C.

The function of the check valve 13 is to prevent the refrigerant from flowing to the evaporator 1. The check valve 13 performs its function if the pressure at the inlet of the compressor 9 is higher than a pressure at the outlet of the evaporator 1 after: (i) the refrigerant passes through the bypass tube 10 and through the evaporator 1, and (ii) the refrigerant passes through the capillary tube 8 and through the evaporator 1.

Figure 3:
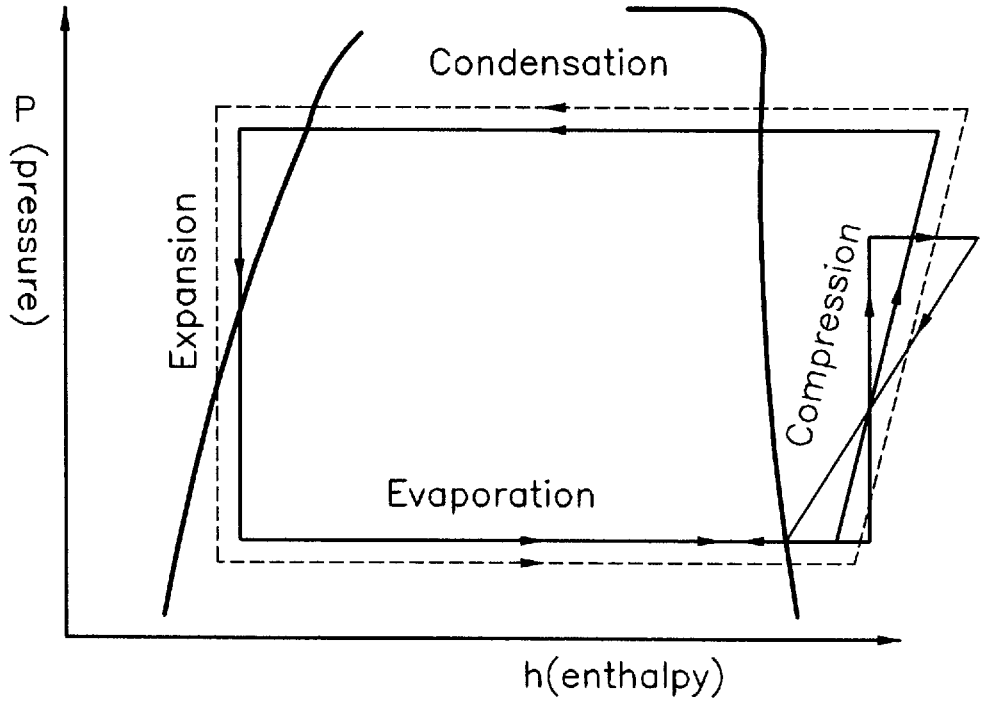
FIG. 3 is a P-h chart in accordance with the embodiment of FIG. 2.

FIG. 3 is a P-h chart which shows a main cycle and a bypass cycle of the refrigerant in accordance with the embodiment of the present invention. The refrigerant of the main cycle passes through evaporation, compression, condensation and expansion process. The refrigerant of the bypass cycle passes a process in which the high-temperature and the high-pressure refrigerant is expanded without a condensation process. The temperature of the refrigerant of the bypass cycle is dropped to remove frost while passing through the evaporator 1.

Figure 6:
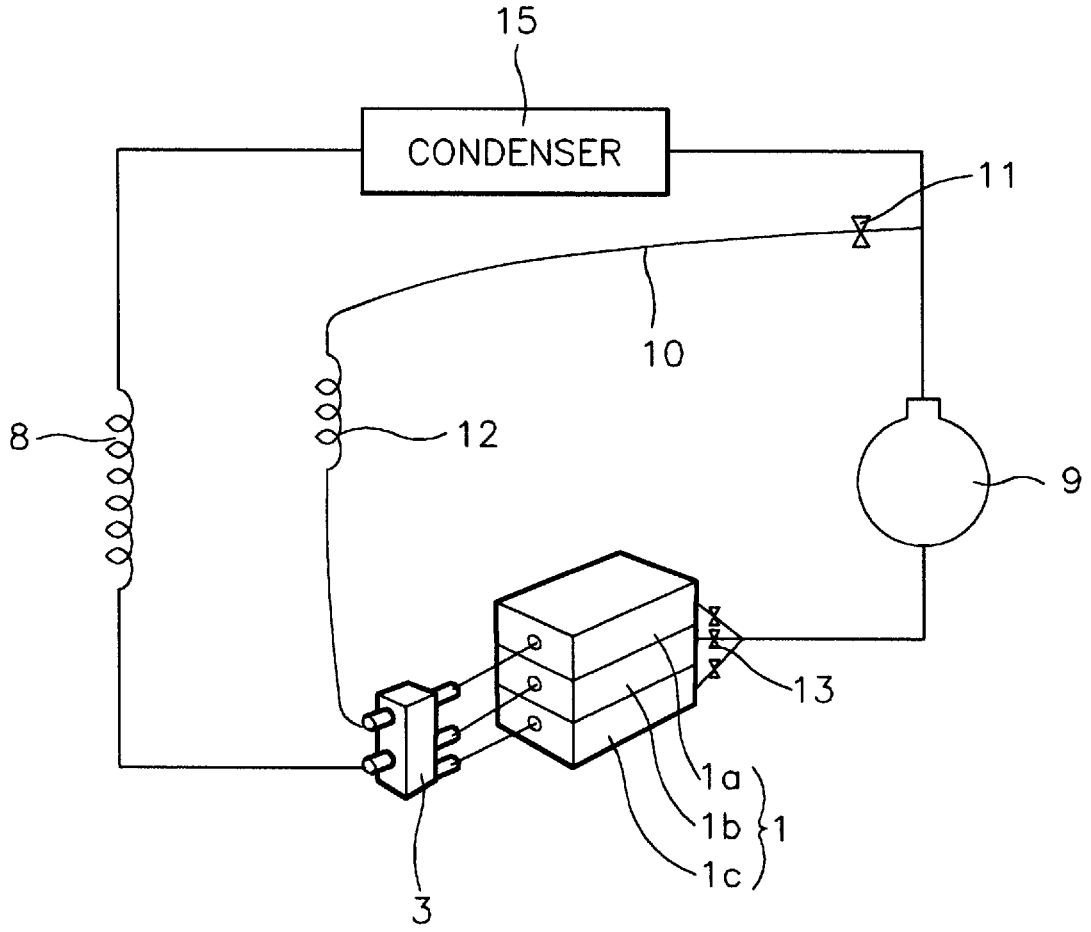
FIG. 6 illustrates another embodiment of the present invention.

FIG. 6 illustrates another embodiment of the present invention, in which the evaporator 1 includes 3 paths. If frost falls on a surface of the evaporator 1, the on-off valve 11 is turned on and the bypass tube 10 induces the refrigerant. First, an upper portion 1*a* is defrosted while middle and lower portions 1*b*,1*c* are used for normal evaporation. Second, the middle portion 1*b* is defrosted, according to the rotation of the converting plate 2, while the upper and the lower portions 1*a*,1*c* are used for normal evaporation. Finally, the lower portion 1*c* is defrosted according to the rotation of the converting plate 2, while the upper and the middle portions 1*a*,1*b* are used for normal evaporation. If necessary, evaporation can be divided into a smaller portion than that of the first or the second evaporation.

As described above, the defroster removes frost which falls on the evaporator without interrupting a heating operation of the heat pump. Also, the heat pump can supply sufficient heat for heating a room because the evaporator functions normally.

It will be apparent to those skilled in the art that various modifications and variations can be made in a defroster for heat pump of the present invention without departing from the spirit or scope of the invention. Thus, it is intended that the present invention cover the modifications and variations of this invention provided they come within the scope of the appended claims and their equivalents.

What is claimed is:

1. A defroster for a heat pump comprising:

refrigerant drawing means for drawing a high-temperature refrigerant from an outlet of a compressor, said high-temperature refrigerant circulating in said heat pump; and refrigerant distributing means for separately supplying both a refrigerant coming from a condenser and said high-temperature refrigerant from the compressor into an inlet of an evaporator, wherein said refrigerant distributing means comprises:

a cylindrical converting valve;

a first inlet tube formed at an upper portion of said cylindrical converting valve for receiving the high-temperature refrigerant drawn by said refrigerant drawing means;

a first outlet tube being level with said first inlet tube for emitting the high-temperature refrigerant into said upper portion of the evaporator;

a second inlet tube formed at a lower portion of said cylindrical converting valve for receiving the refrigerant coming from the condenser;

a second outlet tube being level with said second inlet tube for emitting the refrigerant into said lower portion of the evaporator; and a converting plate rotating in said cylindrical converting valve for connecting said first inlet tube with said first outlet tube while connecting said second inlet tube with said second outlet tube, or for connecting said first inlet tube with said second outlet while connecting said second inlet tube with said first outlet tube, and wherein said refrigerant distributing means alternately sends said high-temperature refrigerant and the refrigerant from the condenser into an upper portion and a lower portion of said evaporator.

2. The defroster for a heat pump as claimed in claim 1, wherein said refrigerant drawing means comprises:

a bypass tube branching off at said outlet of said compressor for inducing said high-temperature refrigerant into said evaporator; and an on-off valve for selectively inducing said high-temperature refrigerant into said bypass tube.

3. The defroster for a heat pump as claimed in claim 1, further comprising a check valve installed at an outlet of said evaporator for preventing refrigerant from flowing backward.

* * * * *